US005419400A

United States Patent [19]

Wigington, Sr.

[11] Patent Number: 5,419,400

[45] Date of Patent: * May 30, 1995

[54] ENVIRONMENTAL VAT

[76] Inventor: James R. Wigington, Sr., P.O. Box 177, Ackerly, Tex. 79713

[ * ] Notice: The portion of the term of this patent subsequent to Jun. 16, 2009 has been disclaimed.

[21] Appl. No.: 870,875

[22] Filed: Apr. 20, 1992

Related U.S. Application Data

[63] Continuation-in-part of Ser. No. 698,951, May 13, 1991, Pat. No. 5,121,796.

[51] Int. Cl.[6] ..... E21B 33/08

[52] U.S. Cl. ..... 166/379; 166/81

[58] Field of Search ..... 166/379, 81, 80, 84; 137/312

[56] References Cited

U.S. PATENT DOCUMENTS

| | | | |
|---|---|---|---|
| 113,638 | 4/1871 | Dewey | 166/81 |
| 1,418,612 | 6/1922 | Beard | 166/81 |
| 1,507,628 | 9/1924 | Schuyler | 166/84 |
| 3,270,810 | 9/1966 | Johnston | 166/81 X |
| 3,353,606 | 11/1967 | Dyer | 166/88 X |
| 4,323,122 | 4/1982 | Knopik | 166/267 |
| 4,665,976 | 5/1987 | Retherford | 166/81 |
| 4,949,784 | 8/1990 | Evans | 166/81 |
| 5,050,676 | 9/1991 | Hess et al. | 166/267 |
| 5,121,796 | 6/1992 | Wigington, Sr. | 166/379 |
| 5,150,751 | 9/1992 | Burton et al. | 166/81 |
| 5,167,277 | 12/1992 | Evans | 166/81 |
| 5,211,244 | 5/1993 | Arterbury | 166/379 |
| 5,228,506 | 7/1993 | Pearce | 166/81 |

*Primary Examiner*—Hoang C. Dang
*Attorney, Agent, or Firm*—Robert M. Wallace

[57] ABSTRACT

A vacuum tank is used to suck slop over 100 feet from a basin attached to the well head of an oil well. A vacuum is initiated in a vacuum tank by a vacuum pump and maintained when liquid flows into the vacuum tank by pumping liquid from the vacuum tank into a holding tank. The liquid from the holding tank is transferred to a truck tank by which it is carried to a place of disposal. The vacuum pump and liquid pump attached to the vacuum tank are powered by a diesel engine through a hydraulic power transmission system. The diesel engine is remotely controlled from the well-head area by a remote control which operates a starting relay at the diesel engine and also which regulates the speed between idle and operating speeds. The remote unit also has a light which indicates if the diesel engine is running.

28 Claims, 5 Drawing Sheets

ENVIRONMENTAL VAT

CROSS REFERENCE TO RELATED APPLICATION

This is a continuation-in-part of my prior application, Ser. No. 07/698,951, filed May 13, 1991, presently in the Issue Branch of the United States Patent and Trademark Office and now U.S. Pat. No. 5,121,796, which was issued on Jun. 16, 1992.

RIGHTS TO INVENTIONS UNDER FEDERAL RESEARCH

There was no federally sponsored research and development concerning this invention.

BACKGROUND OF THE INVENTION

1. Field of the Invention

This invention relates to diesel engines and oil rigs for producing oil wells. Particularly, this invention relates to a remote control for a diesel engine used to transfer sludge and other waste material which flow from an oil casing during maintenance thereof. Also more particularly, this invention relates to preventing pollution of the environment.

2. Description of the Related Art

Often oil is produced from deep within the earth by pumps which pump the oil to the surface of the earth. The pumps, being mechanical devices, often need repair and maintenance. This is normally done with a workover rig which normally will have a derrick to pull sucker rod and tubing from the casing within an oil well. Often, as the sucker rod or the tubing and pump are pulled from the well, oil will be forced out of the well. Particularly if the tubing is pulled the tubing will often be full of crude oil and as each joint of tubing is disconnected, crude oil within the tubing will run out of the tubing. If the oil spills upon the earth it will often be washed by rain water into streams or percolate through the earth into underground aquifers. In either event, pollution of the water in the stream or in the aquifer will occur.

In addition, the crude oil will often have with it many other substances many of which are more harmful than the petroleum products themselves. In addition, many wells produce noxious if not toxic gases. On some wells it is necessary that the workers wear protective breathing equipment.

Many people have previously attempted to control leaks and spills around oil wells. For example, the DEWEY U.S. Pat. No. 113,638 issued in 1871, discloses a bag or rubber sock which may be connected around the top of the tubing on an oil well to prevent leakage from an operating oil well from running upon the ground. DYER U.S. Pat. Nos. 3,353,606, in 1967 and JOHNSTON 3,270,810 in 1966, show similar flexible containers to prevent the loss of oil. Likewise, BEARD U.S. Pat. No. 1,418,612 in 1922, and RETHERFORD U.S. Pat. No. 4,665,976 in 1987, show rigid containers surrounding the tops of operating oil wells to prevent loss.

EVANS, U.S. Pat. No. 4,949,784 issued in 1990, discloses a basin or vat attached around the top of an operating oil well to catch any leakage therein. In this instance the leakage is drained by gravity into an open pit dug in the ground which is lined with a material such as Fiberglass to prevent the crude within the sump from seeping into the earth. It is suggested that the sump be emptied by a hose to suck the material from the bottom of the sump. Petroleum products that had leaked from the well would pass through the surface pump.

SCHUYLER, U.S. Pat. No. 1,507,628, in 1924 devised a vat to attach around the casing. The oil was sucked from the bottom of the vat using an aspirating device which produced a suction by the flow of oil from a pumping oil well. SCHUYLER would operate only when there was a flow of fluid from the oil well.

My prior patent application identified above, described how a vat could be placed around the casing; the vat included a lip to prevent liquid from sloshing out over the edges of the vat. Also the vat was emptied by sucking the fluids into a vacuum tank which pulled the fluids by pulling gas off the top of the vacuum tank. However, in some wells that produced an excess of liquids, there was a problem of the vacuum tank being filled up and the work delayed while the tank was being emptied. Also, the prior application did not disclose a vacuum line directed directly to the casing of the well.

Also, the prior application disclosed only an electric motor to power a vacuum pump.

SUMMARY OF THE INVENTION (1) Progressive Contribution to the Art

This application discloses a means for emptying the liquid from the vacuum tank as work is progressing so that a reduced pressure or vacuum is maintained upon the vacuum tank. Thus the work upon the well is not interrupted.

In addition, remote controls have been developed for diesel engines so that a diesel engine can be used to power the equipment upon the remotely located vacuum tank without a person being positioned at the vacuum tank or having to travel to and from the vacuum tank. Basic procedures around an oil well require that the auxiliary equipment be placed over 100 feet from the well head for safety purposes.

In addition, the equipment on the vacuum tank has been rearranged and redesigned so that the diesel engine operates a hydraulic pump which operates a vacuum pump to remove gas or air from the tank so that an initial vacuum is created. After the initial vacuum is created the hydraulic system can be switched to drive a liquid pump which pumps liquid from the vacuum tank into an open holding tank. The liquid in the open holding tank can remain in the tank for an indefinite period of time until the tank may be emptied into a tank truck. It will be understood that the trailer, which normally carries the vacuum tank, is of a design that is not adapted to be moved when fully filled with liquids. I.e., the weight capacity of the tires and axles are such that they will readily support the vacuum tank full of liquid in a stationary position but not to transport the liquid to a remote point for disposal.

The hydraulic motor operating the liquid pump as well as the liquid pump itself may readily be reversed so that if there is a certain amount of sludge that does not readily flow from the tank, other liquids can be introduced into the vacuum tank for cleaning out the sludge or the like in a washing operation.

Also, when the line is to be disconnected from the holding tank, the pump may be reversed so that the line can be emptied back into the vacuum tank to prevent the polluted liquid within the line from flowing upon the ground.

Also, a connection is provided so that the suction line from the well casing to the vacuum tank can be connected directly into the well casing instead of into the vat so that noxious or toxic gases may be sucked into the vacuum tank. It is understood, of course, that at the vacuum tank the gases are released to the atmosphere but at a sufficient distance to pose no particular hazard to the workmen at the well head.

The difficulty in providing a remote control from the diesel is that the starter as a unit upon a diesel engine needs to be heavy duty equipment and therefore the control circuit or the activating circuit to the starter itself requires a medium amount of current. There is over 200 feet of wire, including over 100 feet to the remote control and over 100 feet back. With the normal current required to operate the controls for the starter, there is sufficient resistance in the normal 14 gauge wire to result in a voltage drop, making the voltage insufficient for reliable operation. Therefore, a light starter relay was placed at the engine where the length of the wiring is a matter of inches rather than feet and the voltage drop is controllable.

In addition to this, the running of the small diesel engine at the vacuum tank cannot be heard above the normal noise of diesel engines which operate the rig machinery. Thus the workmen cannot tell whether the small diesel is running or not. This made it necessary to put an indicator light on the remote control to indicate that it was running. The voltage for the indicator light was conveniently taken from the run circuit. It is to be understood that diesel motors often can carry safety switches which will kill the operation of the engine upon over-heating or loss of oil pressure. Therefore, if the engine stops and there is loss of oil pressure, this switch will open and turn off the indicator light so that the workmen at the rig know of this problem. Also it is desirable at starting that they know that they have actually started the engine which will occur when the oil pressure reaches sufficient pressure to close the safety switch and turn on the indicator light.

(2) Objects Of this Invention

An object of this invention is to prevent oil spills at the well head from polluting the environment.

Another object is to remotely start and operate a small diesel engine.

Further objects are to achieve the above with devices that are sturdy, compact, durable, lightweight, simple, safe, efficient, versatile, ecologically compatible, energy conserving, and reliable, yet inexpensive and easy to manufacture, connect, operate, and maintain.

Other objects are to achieve the above with a method that is rapid, versatile, ecologically compatible, energy conserving, efficient, and inexpensive, and does not require highly skilled people to connect, operate, and maintain.

The specific nature of the invention, as well as other objects, uses, and advantages thereof, will clearly appear from the following description and from the accompanying drawings, the different views of which are not necessarily scale drawings.

Figure 1:
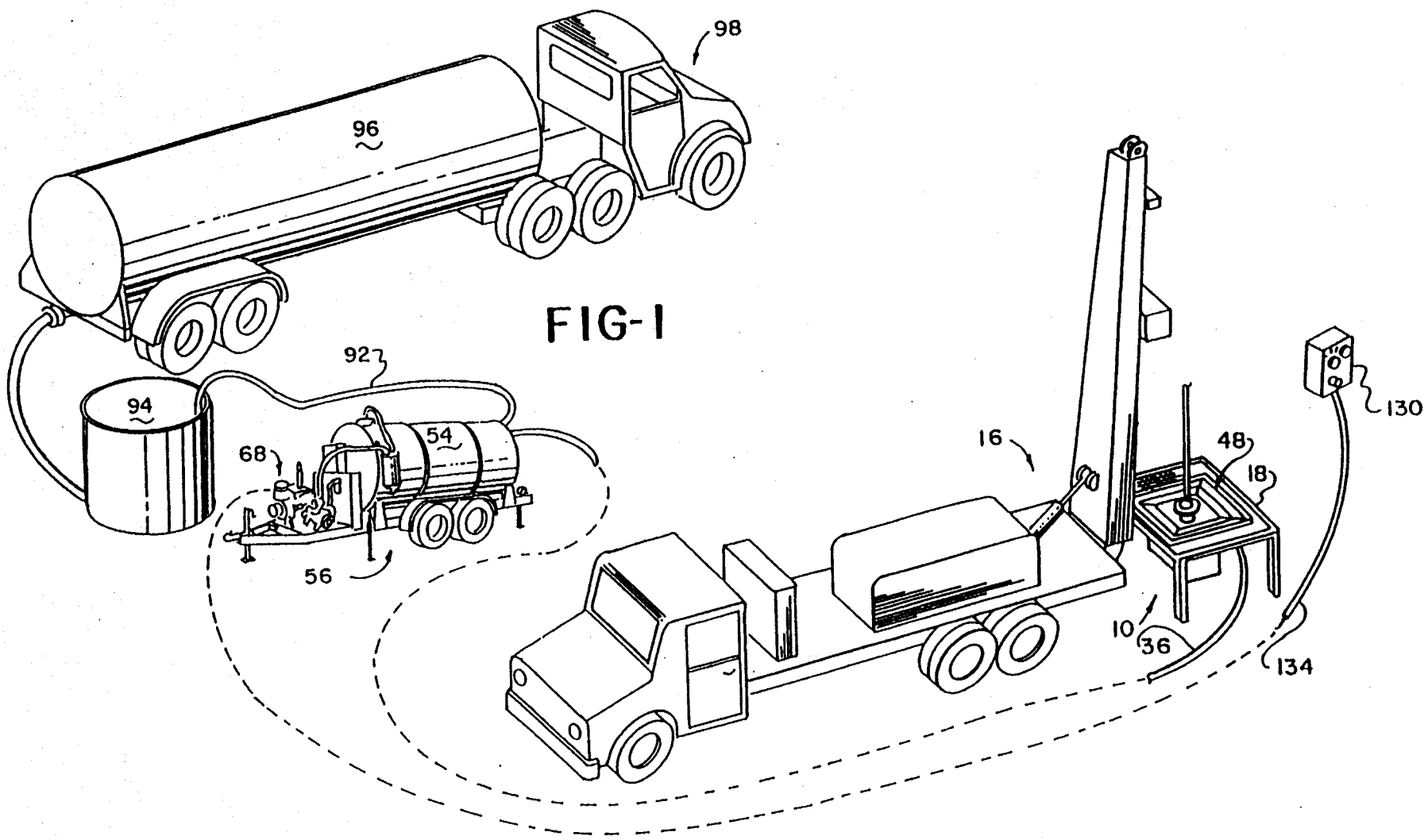
FIG. 1 is a schematic representation of a work-over rig at a well head with the vacuum tank, holding tank, and truck tank connected thereto.
Figure 2:
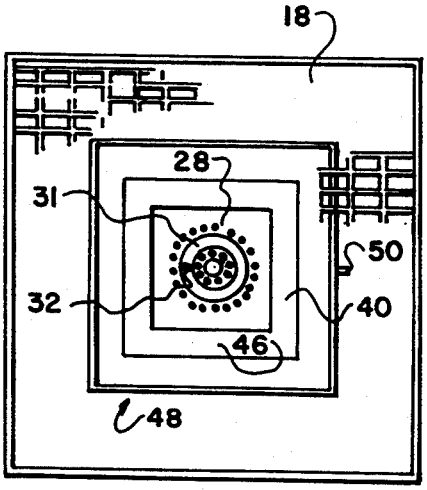
FIG. 2 is a top plan view of the vat according to this invention with portions of the platform of the rig shown mostly broken away.
Figure 3:
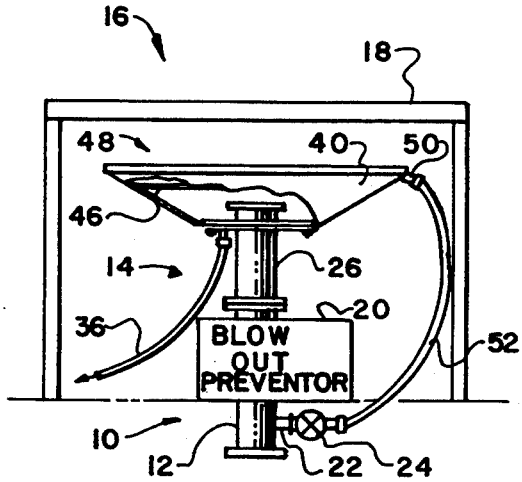
FIG. 3 is a schematic representation of the well head with a vat according to this invention attached thereto.
Figure 4:
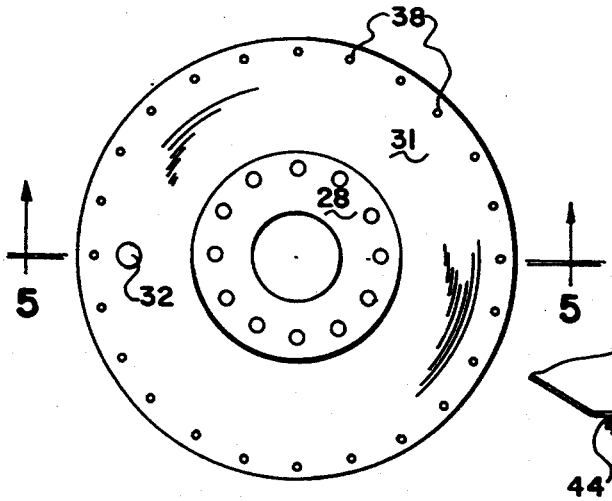
FIG. 4 is a top plan view of the spool with the disk attached thereto.
Figure 5:
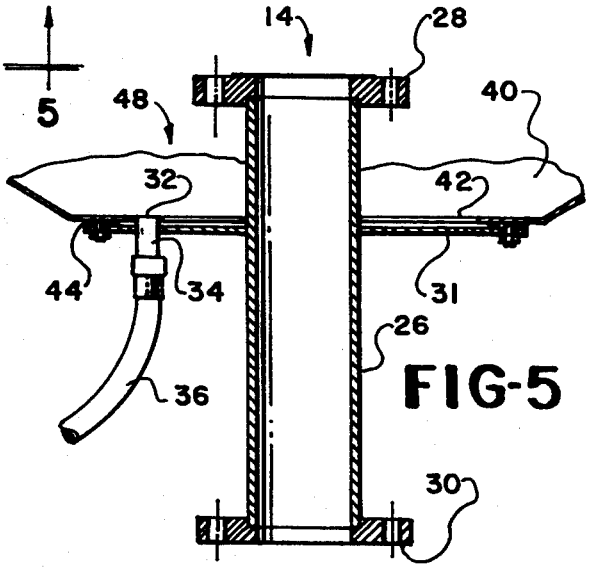
FIG. 5 is a sectional elevational view taken substantially on 5—5 of FIG. 4 showing a portion of the vat attached to the spool.
Figure 6:
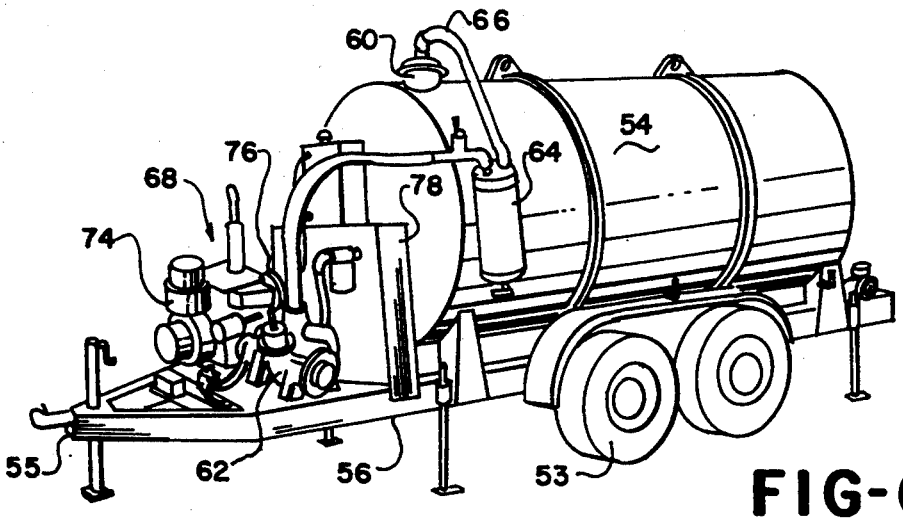
FIG. 6 is a perspective view of the vacuum tank mounted on a trailer with the associated equipment.
Figure 7:
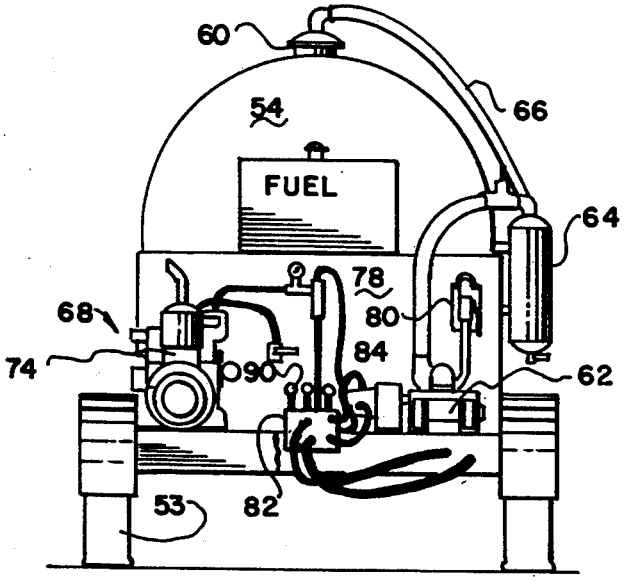
FIG. 7 is a front elevational view of the vacuum tank on the trailer, with part of the tongue broken away.
Figure 8:
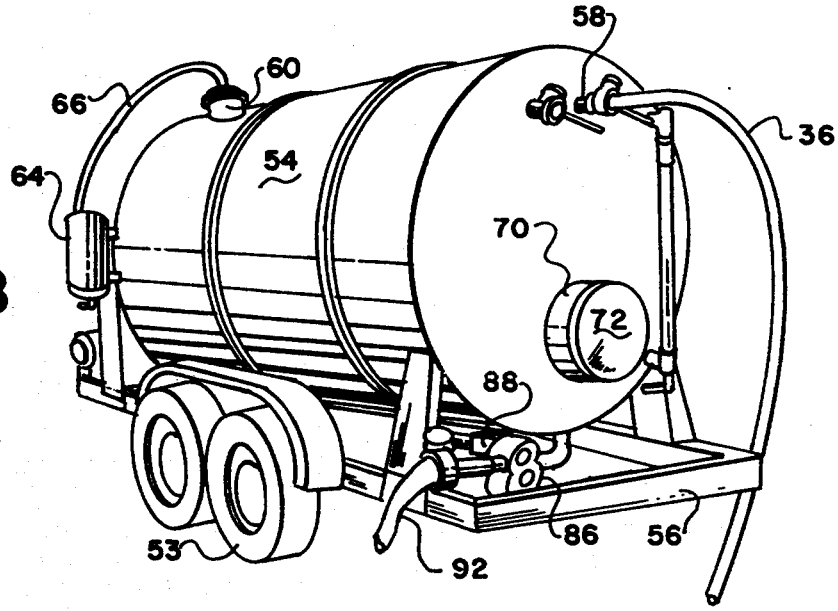
FIG. 8 is a rear perspective view of the vacuum tank on a trailer.

As an aid to correlating the terms of the claims to the exemplary drawings, the following catalog of elements and steps is provided:

10 oil well
12 casing
14 well head
16 rig
18 platform
20 blow out preventor
22 nipple
24 valve
26 spool
28 spool top
30 spool bottom
31 disk
32 drain hole
34 nipple
36 hose
38 bolt holes
40 vat
42 circular hole
44 gasket
46 internal flange
48 basin
50 inlet nipple
52 conduit
53 wheels
54 vacuum tank
55 hitch
56 trailer
58 tank inlet nipple
60 man hole/dome
62 vacuum pump
64 liquid separator
66 vacuum air hose
68 power means
70 clean out opening
72 clean out cover
74 diesel engine
76 hydraulic pump
78 hydraulic reservoir
80 filters 82 valve manifold
84 hydraulic motor
86 liquid pump
88 hydraulic motor
90 reverse valve
92 discharge hose
94 holding tank
96 truck tank
98 truck
100 key switch
102 run switch
104 start switch
106 run solenoid
108 high-amperage connection
110 low amperage connection
112 battery
114 activating circuit
116 starter
118 heavy electrical cable
120 hour meter
122 safety switch
124 speed solenoid
126 connecting rod
128 governor arm
130 remote control unit
132 engine connecting plate
134 electrical cable
136 speed switch
138 remote run switch
140 remote start switch
142 start relay
144 relay switch
146 relay coil
148 indicator light
152 plug
154 board

DESCRIPTION OF THE PREFERRED EMBODIMENT

Referring to the drawing there may be seen, particularly in FIG. 1, the representation of an oil well 10 having casing 12. The casing extends from casing top or well head 14 above the surface of the ground to a bottom far below the surface of the ground.

Also seen is rig 16 which has platform 18 which is around the casing top 14. The platform 18 is conveniently made of grating.

The casing top, or well head, will include blow out preventor 20. The casing 12 will have nipple 22 in the casing immediately below the blow out preventor 20. Valve 24 will normally be in the off position. As shown in my prior application, spool 26 is attached to the top of casing 12. The spool between spool top 28 and spool bottom 30 has disk 31 welded thereto. The casing 22 and the axis of the spool 26 will be vertical and the disk 31 will be at right angles to this axis which is to say the disk will be horizontal. The casing 12 will have a certain diameter, for example 5 inches plus or minus a half inch. The disk typically will have a diameter which is about 8 or 10 times the diameter of the casing. The disk will have drain hole 32 in it. The drain hole will have nipple 34 attached below it. The nipple will be a means for connecting a 2" hose 36 thereto.

Around the perimeter of the disk 31 there will be a series of bolt holes 38.

Vat 40 is preferably of square outer shape for convenience in manufacture. The vat will have a width and a length about 20 times the diameter of the casing. From the top of the vat 40 to the bottom of the vat will be about twice the casing diameter. The vat will have circular hole 42 in its bottom. A series of bolt holes around the circular hole 42 will mate with the bolt holes 38 in the disk 31.

The vat 40 will be bolted to the top of the disk 31. Gasket 44 between the disk and the vat forms a liquid-proof seal between the two. Basin 48 is formed by the spool 26, the disk 31, and the vat 40.

Internal flange 46 is an inch or two below the top of the vat 40. The purpose of the internal flange is to prevent liquids which might flow into the basin 48 from splashing or sloshing out. Internal flange will extend into the vat from the sides thereof a distance about equal to the diameter of the casing.

Inlet nipple 50 is attached at the top of the vat 40 above the internal flange 46. Conduit 52 in the form of a hose is connected from the valve 24 to the inlet nipple 50. Therefore in the event some pressure develops within the casing 12, the blow out preventor 20 may be closed and the valve 24 opened. This will bleed off the pressure from the casing. In the event there are some liquids, either natural or condensate flowing up from the casing, the liquid will drain into the basin 48 as will any spills coming out of the casing.

Hose 36 extends to closed container or vacuum tank 54 which is mounted upon trailer 56. Conveniently the trailer will be located 100 feet or more from the casing so that the trailer is clear of the casing and the rig 16 and the workmen working around it. Also, explosion safety measures require auxiliary equipment to be at least 100 fee from the casing. The trailer 56 will be mounted upon ground engaging wheels 53. Also, as is common with trailers, the trailer will have a hitch 55 which forms a means for moving the trailer 56 and the vacuum tank 54 mounted thereon.

The hose 36 will be connected into tank inlet nipple 58 upon the vacuum tank 54 near the top thereof. The vacuum tank will include man hole with cover or dome 60 on the top thereof.

Vacuum pump 62 is mounted upon the trailer 56. The inlet of the vacuum pump is connected to a liquid separator 64 which is also on the trailer. The inlet of the liquid separator is connected by a suitable vacuum air hose 66 to the man hole/dome 60. Power means 68 is drivingly attached to the vacuum pump 62.

Therefore in operation, if liquid or liquid mixed with sand, mud, paraffin, or other material is found within the oil well 20 or pulled up through the casing 12, spills over the casing top 14, it will flow over into the basin 48. As stated before, the internal flange 46 will prevent the liquid from splashing out of the basin. If the basin begins to fill, the foreman, by operation of suitable controls which will be more fully explained later, can start the power means 68 which will pull a vacuum through the liquid separator upon the vacuum tank 54. Having a pressure less than atmospheric pressure upon the vacuum tank will be transferred to the basin by the hose 36 and the atmospheric pressure upon the liquid in the basin 48 will force the liquid slop in the basin through the hose into the vacuum tank 54. Thus the tank 54 functions as a suction source connected to the drain hole of the basin 48. In the event that some of the liquid in the vacuum tank should reach the outlet in the dome 60, the liquid will be caught in the separator tank 64. If liquids continue to flow into the basin, obviously the motor would remain running to pull the liquid out of the basin substantially simultaneously with pulling the tubing from the casing. However, if there is no continuing flow from the basin, the motor might be turned off by the foreman at the rig 16.

Large clean out opening 70 with a clean out cover 72 is on the vacuum tank.

The invention as described to this point is as described in my prior invention disclosure and as described above, has not been substantially changed.

According to this invention, one change is that the hose 36 may be removed from the nipple 34 and attached to the valve 24. This has certain advantages inasmuch as if there is noxious or toxic gas in the casing, such as hydrogen sulfide, that it may be pulled from the casing for the safety of the workmen.

It will be understood that even if the hose is left connected to the nipple 34, if the vacuum pump is running with an empty vat, the vacuum will produce a reasonable suction to pull off considerable fumes in that vicinity. It will be noted that hydrogen sulfide is slightly heavier than ambient atmosphere, and therefore would not necessarily tend to rise.

According to this invention the preferable form of the power means is small diesel engine 74 having a horse power rating of between about 20 and 25 hp running at speeds from 2000 rpm to 3000 rpm. Diesel engines of this size are readily available commercially. Diesel engine 74 is connected directly to hydraulic pump 76. The hydraulic pump will have the standard elements connected in the standard manner, such as hydraulic reservoir 78 and filters 80 for proper operation. There will also, of course, be by-pass valves to limit the out-put pressure. By valve manifold 82 the hydraulic fluid may be directed to hydraulic motor 84 drivingly connected to the vacuum pump 62 so that the vacuum pump is drivingly connected to the power means 68 as previously described.

As an alternate mode of operation liquid pump 86 is mounted upon the trailer 56. Liquid pump 86 is driven by hydraulic motor 88 which is connected by hoses (not shown) into the valve manifold. Also, the hydraulic motor 88 has reverse valve 90 at the manifold 82 so that it may be driven in the forward direction to pull fluids from the vacuum tank 54. The outlet of the liquid pump 86 is connected to discharge hose 92. The discharge hose leads to open holding tank 94.

As an alternate method of operation once a vacuum has been produced upon the vacuum tank 54 and there is a reasonable supply of liquid within the tank 54, then by removing liquid from the tank 54 by the liquid pump 86 will maintain the vacuum upon the vacuum tank so that liquid is still sucked from the vat 40 into the vacuum tank as before. If the fluid as sucked from the vat 40 produces gas, it may be occasionally necessary to draw gas or air from the vacuum tank by the vacuum pump 62. Oil field workers of ordinary skill will understand this process.

It will be understood that the holding tank will periodically be emptied by pumping the contents of the holding tank into truck tank 96. The truck tank would be a tank mounted upon an over-the-highway truck 98. Such truck tanks and the like are commercially available in the oil-field areas to haul salt water and other pollutants.

Therefore basically the operation of the unit would be that the pollutants or slop that spill into the basin 48 are sucked into the vacuum tank 54 and that the vacuum would be maintained on the vacuum tank by pumping liquids within the vacuum tank 54 into the holding tank 94. Then as the holding tank became filled a truck 98 would be called to empty the contents of the holding tank 94 into the truck tank 96 where it would be hauled to a place of disposal.

The liquid pump 86 is reversible so that the discharge hose 92 can be drained back into the vacuum tank so that there will be no possibility of substantial liquid spillage when operations are discontinued.

If sludge builds up within the vacuum tank liquids can be introduced into the vacuum tank by the liquid pump to flush out sludge. If this is unsuccessful, of course, the clean out opening 70 may be opened by removing the clean out cover 72 and the sludge and the like manually removed at a place suitable for its disposal.

Dependable, inexpensive remote controls for diesel engines were not readily commercially available. Therefore a new remote control was designed and constructed.

Figure 12:
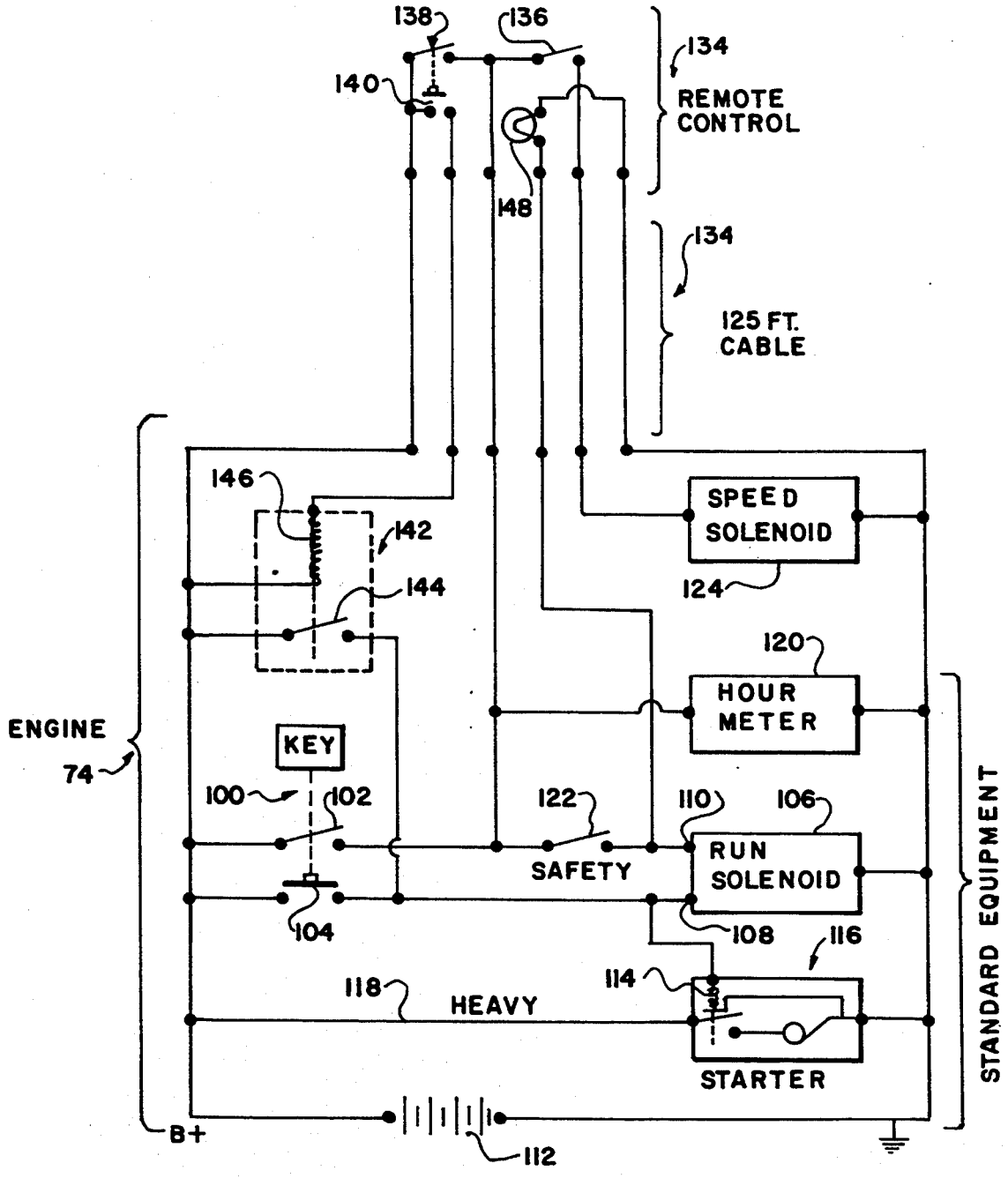
FIG. 12 is a schematic representation of the wiring of the remote control unit and the electrical engine elements pertinent to this invention.

Normally diesel engines have key switch 100 to start the engine.(FIG. 12) This is normally a three-position switch having an off position, a run position, and a spring-loaded start position. By spring loaded it is meant that if there is no manual pressure upon the key that the key will return from the start position to the run position. In the run position the run switch 102 will be closed. Spring loaded start switch is designated as 104.

The standard diesel engine will have a run solenoid which is connected to the "rack" of the fuel injection system so that if the run solenoid is not engaged the engine will not run. The run solenoid 106 has two connections. One is high amperage connection 108 which is used to activate the electro magnet therein. Once the electro magnet is activated to pull the rack into run position it is normally maintained in the run position by low amperage connection 110. Therefore the start switch 104 is used to connect the B+ voltage from battery 112 to activating circuit 114 of starter 116. The starter has heavy electrical cable 118. The activating circuit 114 is connected to the high amperage connection 108 upon the run solenoid 106 so that as the engine is started that the run solenoid is also activated. The low amperage connection to the run solenoid is connected to the B+ connection of the battery 112 by the run switch 102. Hour meters 120 are also connected to the run switch so that any time the run switch is on it is registered as running time upon the hour meter 120.

To prevent damage to the diesel engine 74 there will normally be safety switch 122. The safety switch will be closed if there is sufficient oil pressure for the engine and if the temperature of the engine is below maximum operating limits. Other safety parameters may be connected into the safety switch but at least the oil pressure is one of them. If the oil pressure is below acceptable limits or if the temperature is higher than acceptable limits the safety switch will open. Such switches are standard equipment. The safety switch is connected between the run switch 102 and the run solenoid 106. Therefore, if the safety switch is open there is no current to maintain the run solenoid and it will return to its normal position which disconnects the rack so that the fuel injectors of the engine are inoperable and the engine will not run in such a condition.

Diesel engines are normally run by a governor and these governors are set to adjust the fuel injectors so that whatever speed is set on the governor the engine will by the fuel adjustment will be adjusted to run at that speed.

The description of the diesel engine and its starting and controls as described to this point is normally standard or available on small diesel engines.

To make the diesel engine particularly adaptable for the operation from a control position over a 100 feet from the diesel engine as economically and dependable as possible, speed solenoid 124 is connected to the governor. This solenoid has connecting rod 126 connected to governor arm 128. The effective length of the connecting rod 126 is adjusted by stop nuts upon the connecting rod so that the fast or operating position can be adjusted as well as the slow or idle position. It is desirable to normally adjust these so the idle position is about 1000 rpm and the operating position is about 2000 rpm. The speed solenoid 124 is connected so that without voltage applied to it, it is in the idle position.

Figure 9:
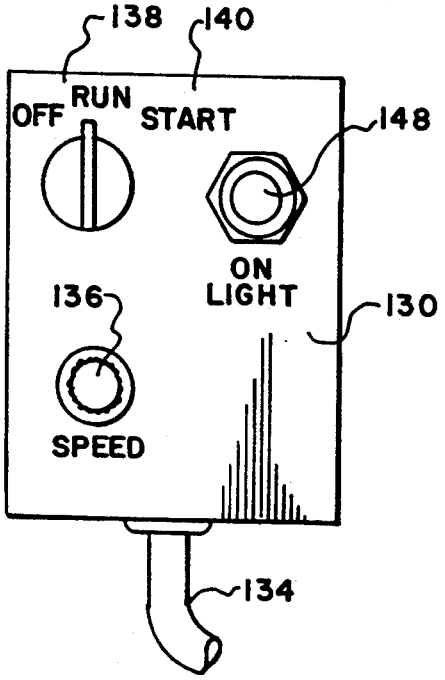
FIG. 9 is a front elevational view of the remote control unit.

Remote control unit 130 (FIG. 9) is connected to engine connection plate 132 (FIG. 10) by about 125 feet of electrical cable 134 which has at least six wires therein. One of the control wires connects to one side of speed switch 136 and by this wire it is connected to the speed solenoid 124. The other side of speed switch 136 is connected between the run switch 102 and the safety switch 122. Therefore if the engine switch is in an off position the speed solenoid is inoperative but once the engine is running the speed solenoid will be operative and if closed the speed solenoid will govern the engine at operating speed.

Also one of the wires in the electric cable 134 carries B+ voltage to remote run switch 138 and remote start switch 140. These two remote switches are, in many respects, the same as the key switch. I.e., when the remote switch 138 is open is the same as when the run switch 102 is open, i.e., there is no connection to the low amperage connection 110 of the run solenoid 106 and therefore the engine will not run. When the remote run switch is closed it is connected parallel to the run switch 102 and therefore the engine runs the same. It is possible to place these two switches in parallel inasmuch as the amperage through the run circuit is very low, about 0.4 amp, and therefore even though it goes through about 250 feet of wire through remote cable 134 that there will be negligible voltage drop and sufficient voltage for the purpose of running the hour meter 120 and maintaining run solenoid 106.

Start relay 142 is mounted at the engine. The start relay has relay switch 144 which is connected parallel to the start switch 104. The start relay 142 has relay coil 146 by which the relay switch 144 is closed when the coil is activated. The coil is activated by the remote start switch 140. The remote start switch being connected between the B+ wire and the relay coil 146. Therefore since the relay switch 144 is mounted upon the engine itself there is only a few inches of wire between the battery B+ to the starter activating circuit 114.

The two other wires in the 125 foot cable are a ground wire and a light wire. The light wire is attached to the low amperage connection 110 of the run solenoid 104. Indicator light 148 is connected between these two wires which is to say, is electrically connected between the low amperage connection 110 upon the run solenoid 106 and the ground. Therefore, any time the safety switch 122 is closed, which is to say any time the diesel engine is running, the indicator light will be burning. Therefore the indicator light will indicate by its being lighted that the diesel engine has started and that the operator on the rig platform can release the remote start switch 140, inasmuch as it is started. Also, of course, any time that it is out he could start again.

Figure 10:
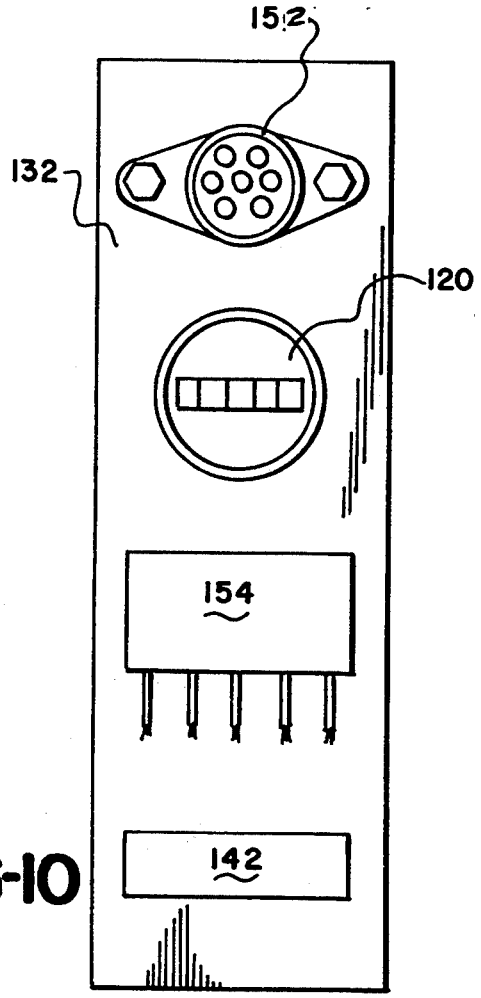
FIG. 10 is a front elevational view of the panel which is mounted on the engine.
Figure 11:
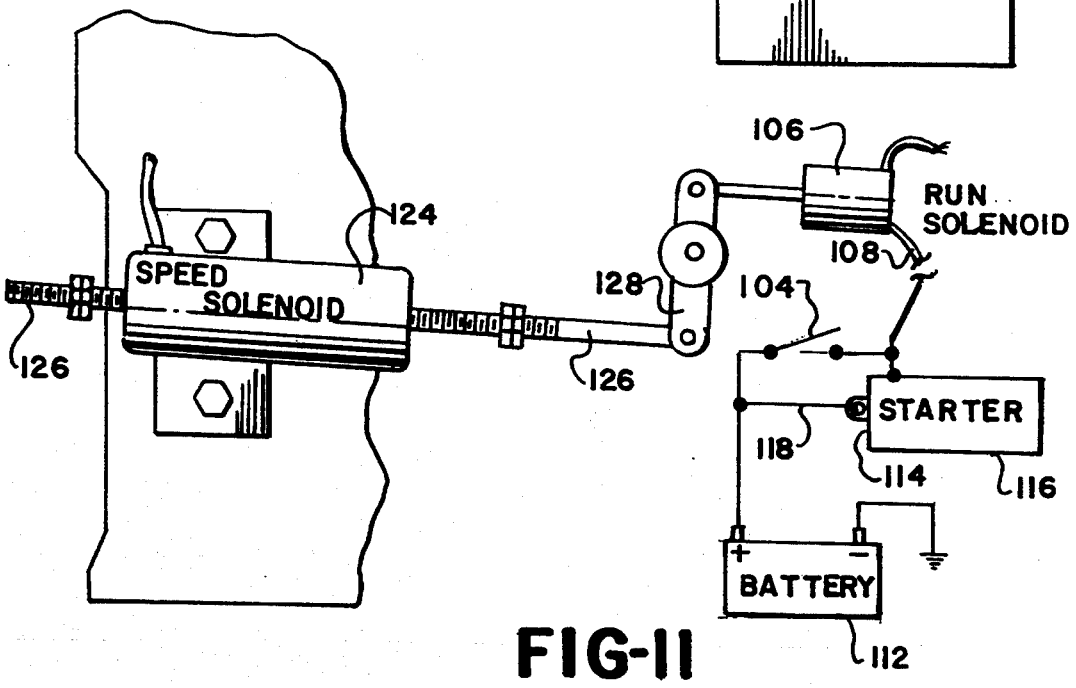
FIG. 11 is a representation of the diesel engine somewhat schematic showing some of the parts and solenoids used in connection with this invention.

FIG. 10 shows the panel 132 which is installed with the remote control unit and to which, in this particular instance, the hour meter 120 is attached. Also attached to this is plug 152 by which the engine end of the 125 foot cable 134 is connected. The connections from the plug 152 normally go to connection board 154 where they are connected to wires extending to other parts of the engine. Also the relay 142 is mounted upon this board. For convenience, the plug 152 may be a conventional plug as is often used on trucks to make electrical connections to truck trailers.

The embodiment shown and described above is only exemplary. I do not claim to have invented all the parts, elements or steps described. Various modifications can be made in the construction, material, arrangement, and operation, and still be within the scope of my invention.

The restrictive description and drawings of the specific examples above do not point out what an infringement of this patent would be, but are to enable one skilled in the art to make and use the invention. The limits of the invention and the bounds of the patent protection are measured by and defined in the following claims.

I claim as my invention:

1. An apparatus for preventing spills around a well head including a. a frame, aa. a basin formed around the well head, b. a closed vacuum tank operatively connected to said basin for receiving spilled fluid, said vacuum tank having a top and bottom on the frame, c. ground engaging wheels on the frame, d. means on the frame for moving the frame and tank, e. an inlet on the tank attached to an inlet hose connected to the basin formed around the well head, and f. a vacuum pump on the frame having g. an inlet connected to the top of the vacuum tank; wherein the improvement comprises:

h. a source of mechanical power on the frame drivingly connected to j. a hydraulic pump, k. a vacuum hydraulic motor fluidly connected to the hydraulic pump by l. a hydraulic vacuum valve, m. said vacuum hydraulic motor mechanically and drivingly connected to said vacuum pump, n. a liquid hydraulic motor fluidly connected to the hydraulic pump by o. a hydraulic liquid valve, p. said liquid pump mechanically and drivenly connected to said liquid hydraulic motor, and q. the liquid pump having i. an inlet connected to the bottom of the vacuum tank and ii. an outlet connected to an iii. outlet hose.

2. The invention as defined in claim 1 further comprising:

r. clean out man hole near the bottom of the vacuum tank.

3. The invention as defined in claim 1 further comprising:

r. a valve open to the atmosphere on the top of the vacuum tank.

4. The invention as defined in claim 1 further comprising:

r. an open holding tank to which the outlet hose is attached.

5. The invention as defined in claim 1 further comprising:

r. said liquid hydraulic motor being reversible so that liquid may be pumped from the hose into the vacuum tank.

6. The invention as defined in claim 5 further comprising:

s. a blow off opening in the bottom of the vacuum tank, and t. a valve attached to said blow off opening.

7. The invention as defined in claim 1 further comprising:

r. a liquid trap connected between the inlet of the vacuum pump and the top of the vacuum tank.

8. The invention as defined in claim 1 wherein:

r. said source of mechanical power on the frame is a diesel engine, and further comprising:

s. a control box at a location spaced away from the diesel engine and connected to the diesel engine by a multi-wire control cable, t. said control box having i. a start switch means for starting the engine, ii. a run switch means for killing the engine, and iii. a speed switch means for running the engine at one of two speeds consisting of an operation speed and an idle speed.

9. A process involving an a. oil well and rig having b. a casing having i. a top above the surface of the earth, and ii. a bottom far below the surface of the earth, iii. tubing in the casing, and c. a platform on the rig extending around the casing, d. wherein the improved method comprises:

e. pulling the tubing from the casing, f. disconnecting joints of tubing thereby g. spilling liquids from the casing, and the tubing, h. catching spilled liquids from the casing in an open basin below the platform, j. draining the basin substantially simultaneously with pulling the tubing as defined above, k. by sucking the liquid from a drain hole in the bottom of the basin by the steps of l. connecting the drain hole to a suction source, and m. reducing the pressure at the suction source.

10. The invention as defined in claim 9 further comprising:

n. said step of reducing the pressure at the suction source reduces the pressure to less than atmospheric pressure.

11. A method of preventing spills around a well head, said method comprising the steps of:

catching spilled liquid in a basin formed around the well head;

sucking the spilled liquid from the basin into a container by maintaining a pressure inside the container below the pressure in the basin;

pulling a vacuum through a liquid separator in fluid communication with the container to maintain the pressure inside the container below the pressure in the basin; and pumping the liquid from the container through a discharge line isolated from the separator into a holding tank.

12. The method as claimed in claim 11, wherein the pressure in the basin is atmospheric pressure, and the pressure inside the container is below atmospheric pressure, and wherein the step of maintaining a pressure inside the container below atmospheric pressure comprises the step of withdrawing a gas from the container.

13. The method as claimed in claim 11, wherein during said pumping step the liquid is pumped into said holding tank.

14. The method as claimed in claim 13, further comprising the step of pumping the liquid from the holding tank into a truck tank for transporting the liquid to a disposal site.

15. A method of preventing spills around a well head, said method comprising the steps of:

providing a suction source comprising a pair of disjunct suction sources separately coupled at distal first and second connections to a vacuum tank;

connecting one of the disjunct suction sources to a discharge line operatively connected to the vacuum tank at the second connection;

utilizing the other disjunct suction source connected to the first connection to suck a fluid from a basin formed around a well head into the vacuum tank;

maintaining a suction on the discharge line with the disjunct suction source connected at the second connection to pump liquid from the vacuum tank into a holding tank;

maintaining a vacuum in the vacuum tank by pumping liquid from the vacuum tank into the holding tank when the other disjunct suction source connected to the first connection is inactivated; and pumping the liquid from the holding tank into a truck tank.

16. A method as claimed in claim 15, further comprising the step of transporting the truck tank to a disposal site.

17. A method of preventing spills around a well head, said method comprising the steps of:

pulling a string of tubing from the well head;

disconnecting a joint of tubing from the tubing string;

retaining liquids that may spill from the well head after disconnecting the joint in an open basin formed around the well head;

draining the liquid in the basin through a drain hole in the bottom of the basin;

connecting the drain hole to a container having a discharge line;

providing a suction source comprising a pair of disjunct suction sources separately coupled to the container and the discharge line;

isolating the discharge line from the other vacuum source leading to the container; and selecting at least one of said disjunct suction sources to apply suction to suck said liquid into the container.

18. A method as claimed in claim 17 wherein during said draining step, said pressure at the suction source is reduced to a pressure which is less than atmosphere pressure.

19. An apparatus for preventing spills around a well head, said apparatus comprising:

a basin formed around the well head:

a vacuum tank for receiving spilled fluids from the basin;

a vacuum pump having an inlet connected to an upper portion of the vacuum tank;

a liquid pump having an inlet connected to a bottom portion of the vacuum tank;

a vacuum motor for driving the vacuum pump; and a liquid motor for driving the liquid pump.

20. An apparatus as claimed in claim 19, further comprising a clean out man hole near a bottom of the vacuum tank.

21. An apparatus as claimed in claim 19, further comprising a valve connected to a top portion of the vacuum tank, said valve being open to atmosphere.

22. An apparatus as claimed in claim 19, further comprising a holding tank connected to an outlet of the liquid pump.

23. An apparatus as claimed in claim 19 wherein said liquid motor is reversible so that an outlet from the liquid pump may be evacuated.

24. An apparatus as claimed in claim 23, further comprising a blow off opening in said bottom portion of the tank and a valve connected to said blow off opening.

25. An apparatus as claimed in claim 19, further comprising a liquid trap connected between the inlet of the vacuum pump and said upper portion of the vacuum tank.

26. An apparatus as claimed in claim 19, further comprising:

a hydraulic power source for powering at least one of said motors;

a control box for controlling the hydraulic power source, said control box being spaced away from said power source and connected to said power source by a control cable;

said control box including a start switch for starting the power source;

a run switch for stopping the power source; and speed switch means for switching a speed of the power source between an operation speed and an idle speed.

27. An apparatus as claimed in claim 26 wherein said hydraulic power source includes a hydraulic pump driven by a diesel engine.

28. An apparatus as claimed in claim 19 wherein said vacuum motor and said liquid motor are hydraulic motors.

* * * * *